US005370287A

United States Patent [19]

Cormier

[11] Patent Number: 5,370,287

[45] Date of Patent: Dec. 6, 1994

[54] DIVISIBLE BACKPACK

[75] Inventor: Odilen A. Cormier, Northfield, N.H.

[73] Assignee: Cormier Corporation, Laconia, N.H.

[21] Appl. No.: 980,717

[22] Filed: Nov. 24, 1992

[51] Int. Cl.[5] ..... A45F 3/04

[52] U.S. Cl. ..... 224/209; 224/153; 224/210

[58] Field of Search ..... 224/151, 153, 155, 209, 224/210, 259, 261, 919

[56] References Cited

U.S. PATENT DOCUMENTS

| | | | |
|---|---|---|---|
| D. 319,144 | 8/1991 | Goude . | |
| D. 319,145 | 8/1991 | Goude . | |
| 2,540,165 | 8/1946 | Fiel . | |
| 4,236,657 | 12/1980 | Bruton | 224/153 |
| 4,424,841 | 10/1984 | Smith . | |
| 4,673,070 | 6/1987 | Ambal . | |
| 4,756,394 | 7/1988 | Cohen . | |
| 4,874,340 | 10/1989 | Smallwood | 224/153 X |
| 4,883,207 | 11/1989 | McArthur | 224/153 |
| 4,907,897 | 2/1990 | Briggs et al. . | |
| 4,925,064 | 5/1990 | Comora . | |
| 5,062,557 | 11/1991 | Mahvi et al. | 224/153 |

FOREIGN PATENT DOCUMENTS

| | | | |
|---|---|---|---|
| 2551331 | 3/1985 | France | 224/153 |
| 177380 | 12/1921 | United Kingdom | 224/209 |

*Primary Examiner*—Renee S. Luebke
*Attorney, Agent, or Firm*—Stephen G. Matzuk

[57] ABSTRACT

A backpack comprising at least two major portions joined at their perimeter to form an enclosed volume and separably and independently useful by the user as weather protective devices, seating pads, and other user activity related articles. The portions are sufficiently rigid to permit portions to retain a preformed, ornamental shape and provide the above-mentioned structures.

8 Claims, 5 Drawing Sheets

DIVISIBLE BACKPACK

FIELD OF THE INVENTION

The present invention relates to back packs, and more particularly to divisible back packs having independently useable component elements.

BACKGROUND OF THE INVENTION

The popularity and utility of backpacks relate to their ability to carry objects relevant to the user in his activities. Except for the largest backpacks, the inclusion of items such as weather protective items and seating cushions are difficult to include in the backpack.

SUMMARY OF THE INVENTION

According to one embodiment, the present invention comprises a two-piece backpack which pieces are joined at their perimeter to form an enclosed volume. The two pieces are separable to be independently useful to the user as seating pads, weather protective devices or other activity related articles or appliances. Moreover, the two pieces are sufficiently rigid to retain a preformed, ornamental shape and to provide the abovementioned structures having the enclosed volume.

BRIEF DESCRIPTION OF THE DRAWING

These and further features of the present invention can be better understood by reading the following Detailed Description together with the Drawing, wherein.

DETAILED DESCRIPTION OF THE INVENTION

Figure 1A:
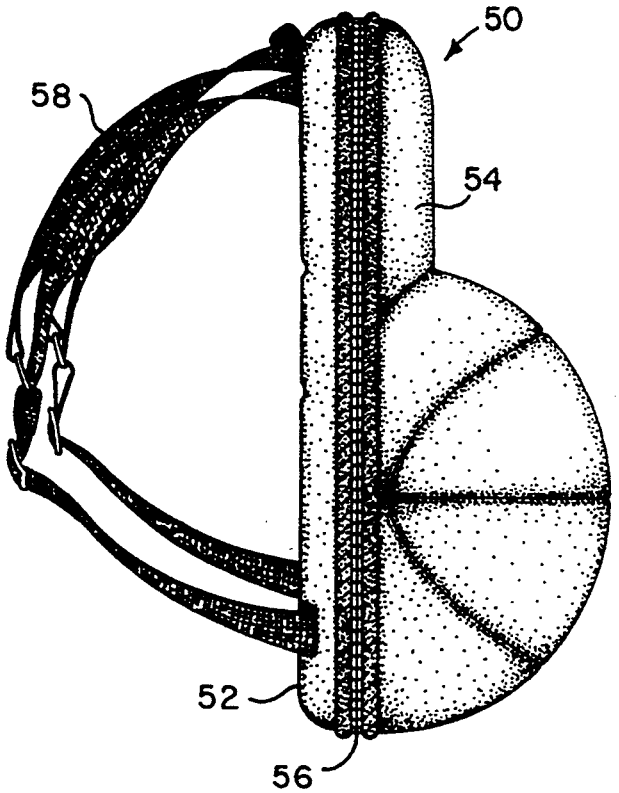
FIG. 1A and FIG. 1B are left and right elevation views of one embodiment of the present invention.
Figure 1B:
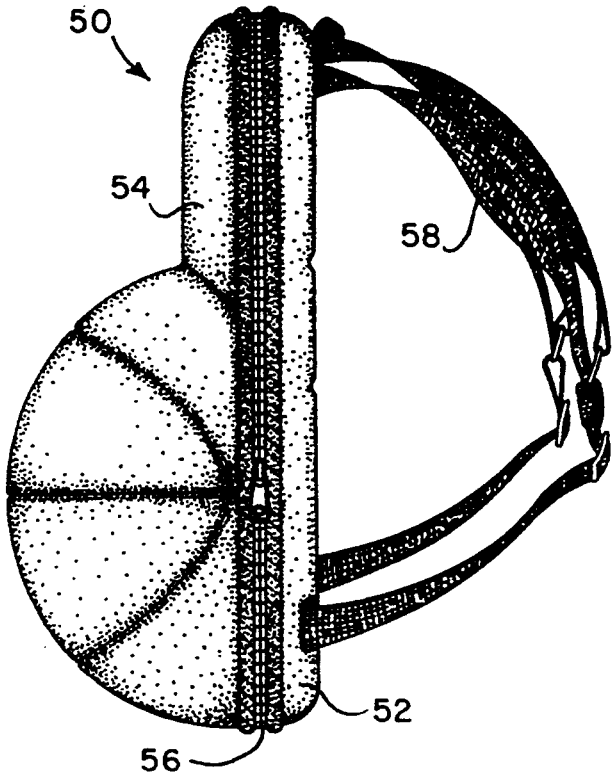
Figure 2A:
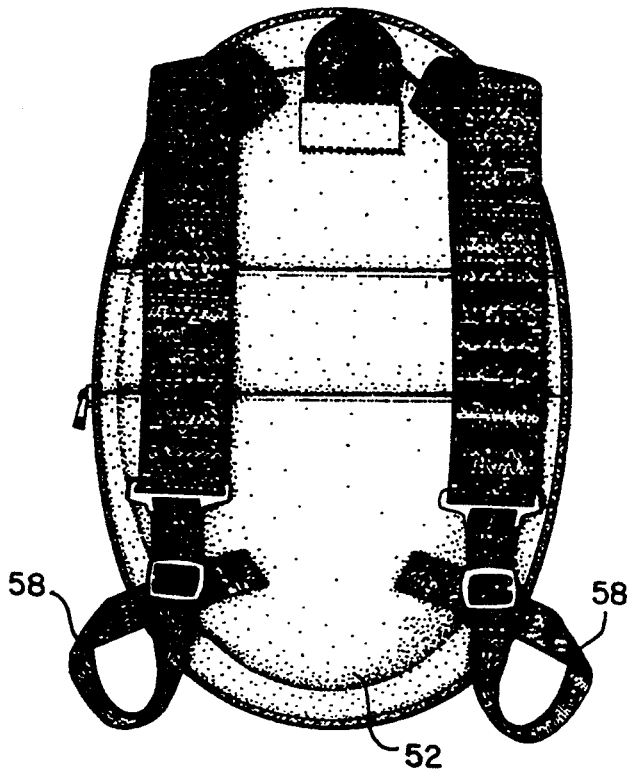
FIG. 2A and 2B are front (facing user) and rear elevation views of one embodiment of the present invention.
Figure 2B:
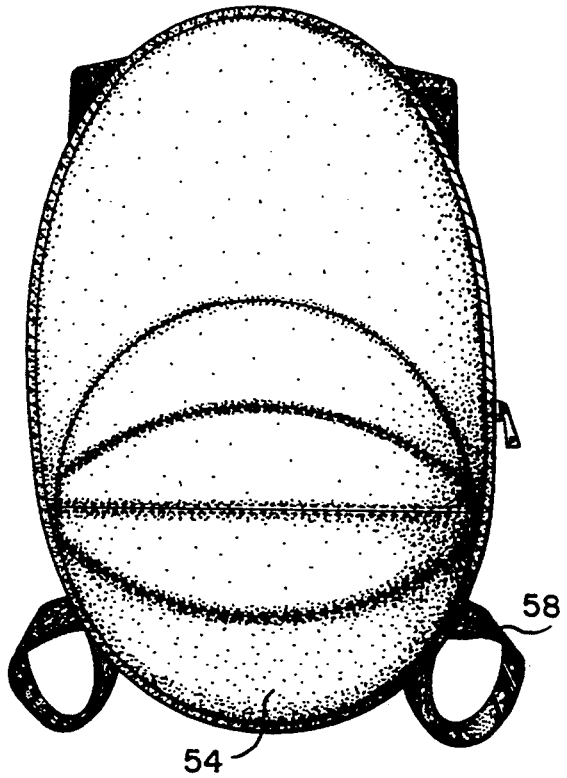
Figure 3A:
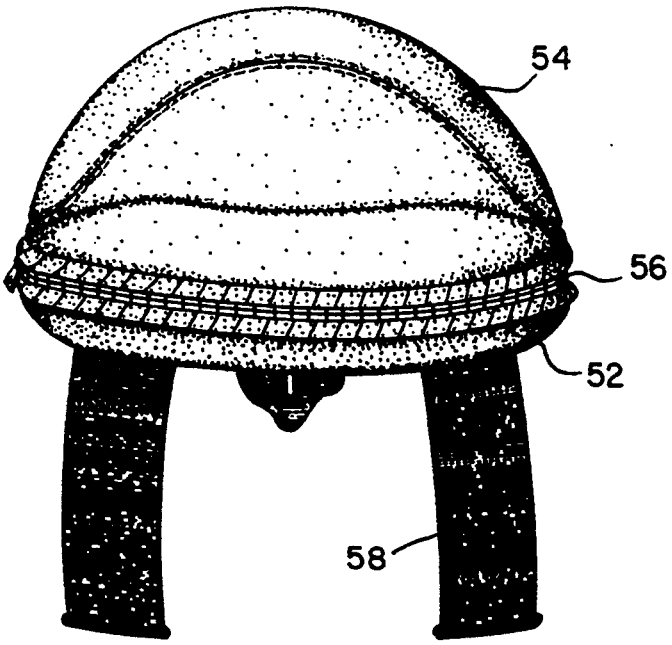
FIG. 3A and FIG. 3B are top and bottom views of one embodiment of the present invention.
Figure 3B:
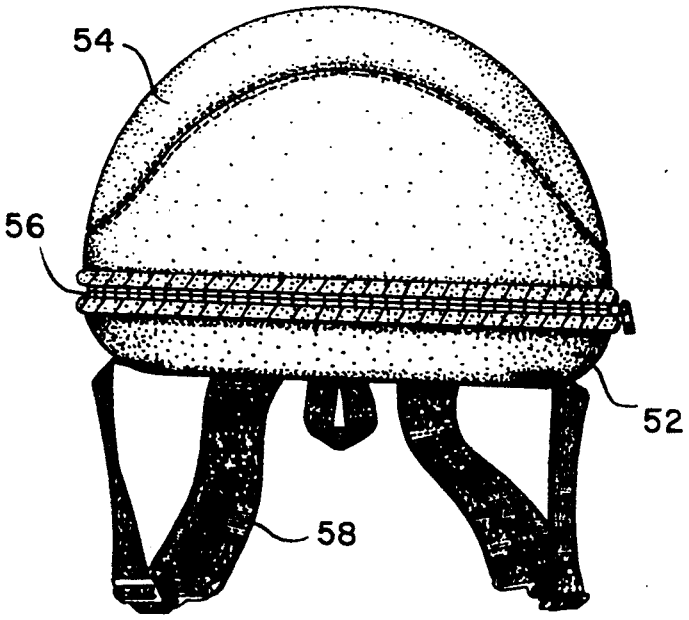

The left and right elevation views of one embodiment of the present invention 50 are shown in FIGS. 1A and 1B, wherein a generally planar portion 52 is attached to a convex second portion by a zipper 56 about the perimeter of the two portions. The strips 58 attach to the front (facing user) portion 52. One or both portions include a molded interior shell of rigid, but pliant foam material covered by suitable cover material, e.g. polyester fabric. The foam material may be molded to resemble an object favored by the user, e.g. a basketball and other familiar objects. Top and bottom elevation views of the embodiment 50 of the present invention shown in FIGS. 1A and 1B are shown in FIGS. 3A and 3B; similarly, corresponding front and rear elevation views of the embodiment are shown in FIGS. 2A and 2B.

Figure 4A:
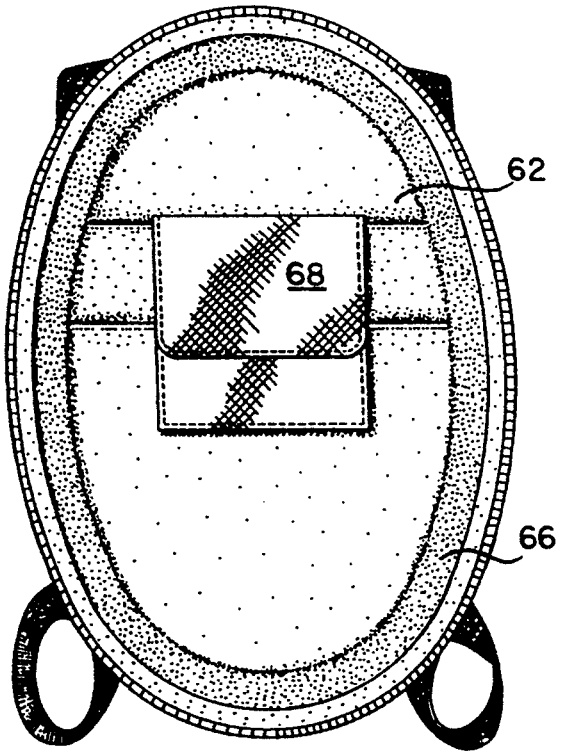
FIG. 4A and FIG. 4B are interior views of the first and second portions of one embodiment of the present invention.
Figure 4B:
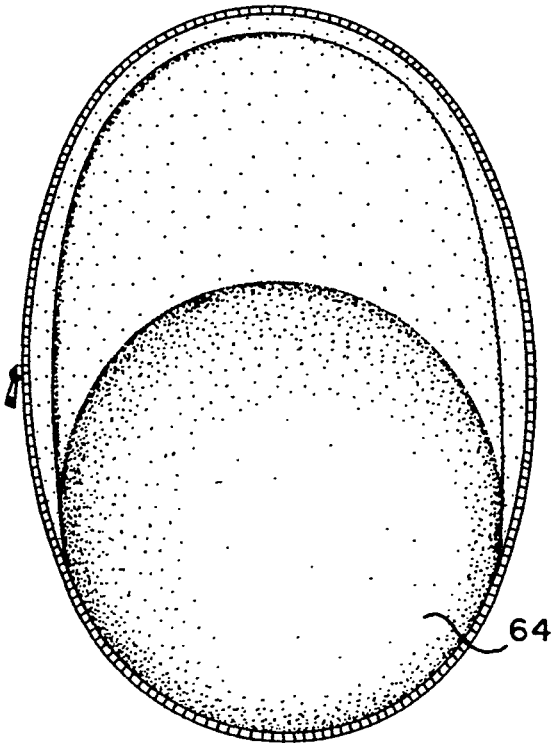
Figure 5A:
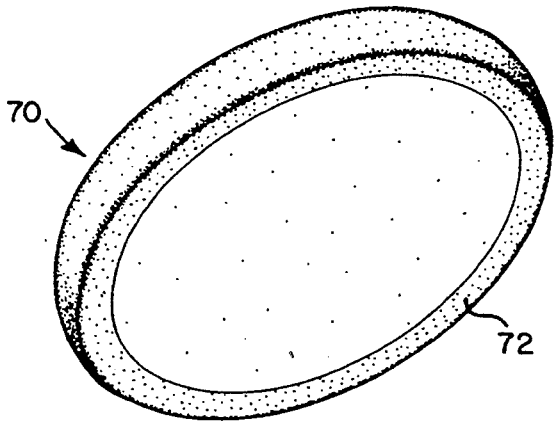
FIG. 5A and FIG. 5B are perspective views of the cushion end head suspension element according to one embodiment of the present invention.
Figure 5B:
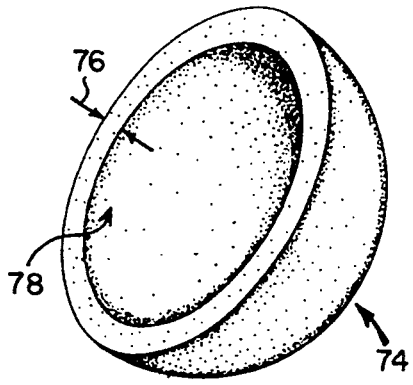
Figure 6A:
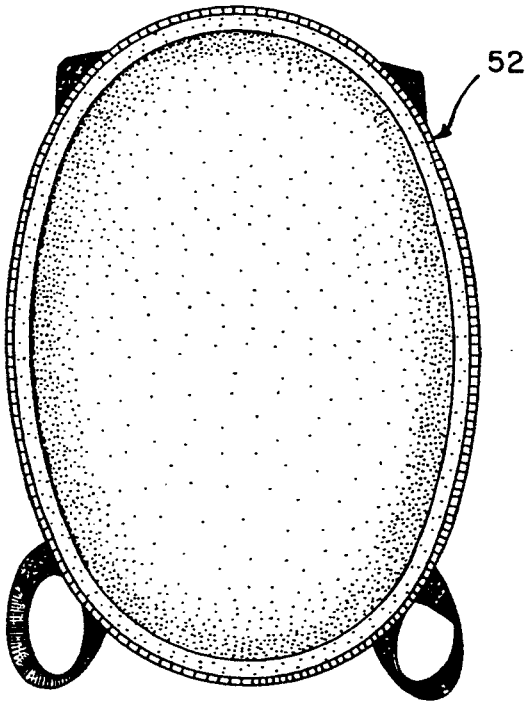
FIG. 6A and FIG. 6B are interior views of the first and second portions of FIG. 4A and 4B with the cushion and head suspension element of FIG. 5A and 5B installed.

Interior elevation views of one embodiment of the first and second portions are shown in FIGS. 4A and 4B, revealing the concave interior 64 of the second portion (54), and the Velcro TM strip 66 on the interior surface 62 of the first portion (52) for retaining the cushion 70 or other user appliance, shown in FIG. 5A, having a corresponding mating Velcro TM strip 72 about perimeter of a generally planar surface. The installed cushion 70 is shown in FIG. 6A. A pocket 68 is retained on the inner surface of the first portion (52) and is covered by the cushion 70 when retained by Velcro TM or other suitable retaining structures.

Figure 6B:
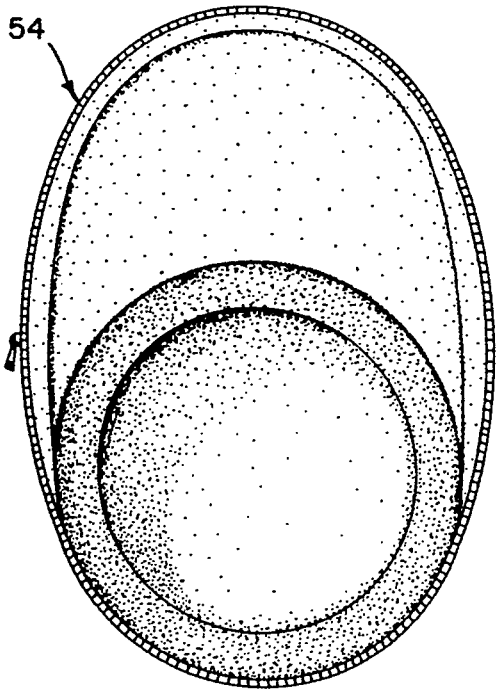

A second user appliance, such as a suspension device 74 is retained within the concave surface of the second portion (54) to permit the rigid structure of the second portion to be suspended over the head of the wearer. The particular embodiment shown provides a second portion in the manner of an umbrella-like oversized "cap", affording protection to the user from sun and rain. The particular embodiment of the suspension device of the present embodiment comprises a resilient foam hemispherical device having a thickness 76 and an inner recess 78 to accommodate the head of the user, and suspend the second portion on the head of the user. The suspension device is shown installed in the second portion in FIG. 6B.

The first, generally planar portion 52 retains shoulder straps 58 which enable the backpack to be worn by the user. When detached from the second portion 54, the planar portion 52 reveals a seat cushion. The second, generally convex portion 54 encloses the majority of the volume of the backpack. The convex portion is sufficiently rigid to maintain a pre-formed shape Which may include an ornamental rendering of an object familiar to the user, e.g. a sport object such as a basketball, as shown in the figures.

Modifications and substitutions of the present invention by one of ordinary skill in the art are included in the scone of the present invention, which is not to be limited, except by the claims which follow.

What is claimed is:

1. A divisible backpack, comprising:

a first, generally planar portion having a perimeter;

a first user appliance attached to said first portion;

a second portion having a perimeter and an outer convex surface and an inner concave surface; and a fastener for joining said first and second portions substantially about the perimeter of said first and second portions forming an enclosed volume wherein said first user appliance is retained within said enclosed volume, wherein said second portion comprises material that is sufficiently rigid to maintain said inner and outer surfaces when said enclosed volume is empty, to form a selected profile.

2. The divisible backpack of claim 1, wherein said first appliance comprises a seat pad.

3. The divisible backpack of claim 1, wherein said selected profile includes an ornamental design.

4. The divisible backpack of claim 1, wherein said material that is sufficiently rigid comprises a molded interior structure.

5. The divisible backpack of claim 1, further including a second appliance comprising a suspension device for retaining and positioning said second portion over the head of the user.

6. The divisible backpack of claim 5, wherein a head of a wearer has an outer surface, the outer surface of the head and the interior of said concave surface define a difference distance, and wherein said suspension device comprises a resilient, generally hemispherical element having a thickness corresponding to the difference distance.

7. The divisible backpack of claim 1, wherein at least one of said first and second portions includes a third user appliance.

8. The divisible backpack of claim 7, wherein said third user appliance comprises a pocket.

* * * * *